US006161492A

United States Patent [19]

Dyer

[11] Patent Number: 6,161,492

[45] Date of Patent: Dec. 19, 2000

[54] TROLLING PLATE CONSTRUCTION

[76] Inventor: William B. Dyer, 3358 Taylor Rd., Central Point, Oreg. 97502

[21] Appl. No.: 09/271,186

[22] Filed: Mar. 17, 1999

[51] Int. Cl.[7] ..... B63H 25/44

[52] U.S. Cl. ..... 114/145 A; 114/145 R

[58] Field of Search ..... 114/145 A, 145 R, 114/274, 280, 282; 440/51, 66, 900

[56] References Cited

U.S. PATENT DOCUMENTS

| | | | |
|---|---|---|---|
| 1,576,237 | 3/1926 | Dawson | 440/66 |
| 2,050,336 | 8/1936 | Karasinski | 115/17 |
| 2,256,898 | 9/1941 | Ehmke | 115/5 |
| 2,719,503 | 10/1955 | Smith | 115/18 |
| 3,136,280 | 6/1964 | Bergum | 114/145 A |
| 3,965,838 | 6/1976 | Uht | 114/145 A |
| 4,278,040 | 7/1981 | Doerffer et al. | 114/170 |
| 4,549,498 | 10/1985 | Meyer et al. | 114/145 A |
| 5,005,507 | 4/1991 | Dyer | 114/289 |
| 5,127,353 | 7/1992 | Wieser | 114/145 A |
| 5,421,279 | 6/1995 | Louks et al. | 114/145 A |
| 5,493,990 | 2/1996 | Dyer | 114/145 A |
| 5,645,009 | 7/1997 | Lexau | 114/274 |
| 5,711,241 | 1/1998 | Dyer | 114/145 |
| 5,715,768 | 2/1998 | Anderson | 114/145 A |
| 5,924,378 | 7/1999 | Peterson et al. | 114/145 A |

*Primary Examiner*—S. Joseph Morano
*Assistant Examiner*—Ajay Vasudeva
*Attorney, Agent, or Firm*—James D. Givnan, Jr.

[57] ABSTRACT

A trolling plate having first and second plate members joined in hinged fashion with one of the trolling plates moveable to a trailed inclined position in the presence of boat propulsion system backwash associated with speeds in excess of trolling speeds. Spring components reposition the trailing inclined plate member upon resumption of reduced boat speed and reduced backwash forces. Trailing of the plate member during high backwash force avoids trolling plate damage and, in some trolling plate assemblies avoids undesired unlatching of the trolling plate from an operative vertical position.

5 Claims, 5 Drawing Sheets

45
46
32
32
31
31
39
39
30
33
33
38
35
36
38
37
37
43
43
40
42
42
38
34
34

45
46
31
32
39
33
38
30
42
37
43
34
42
34

68
66
64
67
65
69
53
51
56
54
50
55
60
52
58
62
61
59

TROLLING PLATE CONSTRUCTION

BACKGROUND OF THE INVENTION

The present invention pertains generally to trolling plate units for attachment to a watercraft propulsion system for the primary purpose of slowing the watercraft to a reduced speed for trolling of a fishing lure.

Trolling plate units, briefly described, include a plate carried by a bracket means attached to a propulsion system such as an outboard motor or outdrive. The trolling plate itself is moveably mounted on the bracket to permit positioning into and out of the backwash of the propulsion system. When raised to the inoperative position, the plate does not interfere with the backwash of the propeller or other propulsion system component. Different locking arrangements are utilized to retain the trolling plate in a down or deployed position and, upon activation, either normally or automatically, permits the plate to reposition upwardly so as to be streamlined with the backwash from the propulsion unit.

U.S. Pat. No. 3,965,838 discloses a trolling plate unit for attachment to the cavitation plate of the lower housing of an outboard motor or outdrive with the trolling plate thereof being manually lockable in both an operative or down position as well as upwardly in a retracted or raised inoperative position. Such a trolling plate is subject to damage when locked in the down position in the presence of increased backwash from a propeller at above trolling speed. In such instances the trolling plate structure must be repaired or replaced necessitating removal from the watercraft, repair and reinstallation, of the plate.

U.S. Pat. Nos. 5,005,507 and 5,493,990 disclose a trolling plate swingably carried by a hydrofoil in place on the lower housing of an outboard motor or stern drive. Characteristically, the trolling plate reduces watercraft speed for purposes of trolling and when retracted, permits the hydrofoil, at increased watercraft speeds, to impart a lifting force to the watercraft. Additionally an automatic release or latch permits automatic trolling plate retraction in the presence of otherwise damaging backwash from a propeller or other propulsion component.

U.S. Pat. Nos. 2,719,503 and 2,256,898 show spring biased trolling plates at all times urged into the backwash of a propeller with the latter patent showing a plate comprising two members simultaneously positionable about individual upright axes and about a single axis in a modified form of the trolling plate.

U.S. Pat. No. 2,050,336 discloses a trolling plate hingedly mounted to a housing of an outboard motor with the plate being spring biased to retain same in place against a propeller backwash at low RPMs. The spring permits displacement of the trolling plate in the event of increased backwash. The trolling plate is of unitary construction with no latch mechanism disclosed to retain the trolling plate in a raised position. Accordingly a motor so equipped would, at all times, operate in an inefficient manner.

U.S. Pat. No. 5,711,241 discloses a trolling plate held in place by spring biased rollers acting on trolling plate appendages for automatic plate release upon increased backwash flow above trolling speeds.

In trolling plate assemblies that utilize a latch mechanism to retain the trolling plate in a lowered or operative position and in a raised position out of a backwash, the latch mechanism typically permits plate retraction in the presence of increased backwash from a propeller or other drive system component to avoid damage to the plate but results in retention of the plate in a raised inoperative position. To relocate the plate downwardly into an operative position rearward of the propeller the watercraft must be slowed or stopped and the latch mechanism actuated to permit spring components to reposition the plate. Such a speed reduction or stopping is undesirable in that it results in a trolled lure or lures gravitating toward the bottom of the lake, river, etc., with an increased risk of snagging on a submerged obstruction.

Important objectives of the present trolling plate construction includes the provision of a trolling plate of segmented construction having main and secondary plate member with means permitting singular displacement of the latter member by propulsion system backwash while the main plate member remains in an operative down position; the provision of a trolling plate having a secondary plate member which is biased into alignment with the main member but may yield in the presence of momentary heavy backwash to prevent damage to the trolling plate assembly and/or the triggering of any latch mechanism permitting retraction of the trolling plate to an inoperative position.

DETAILED DESCRIPTION OF THE PREFERRED EMBODIMENTS

Figure 1:
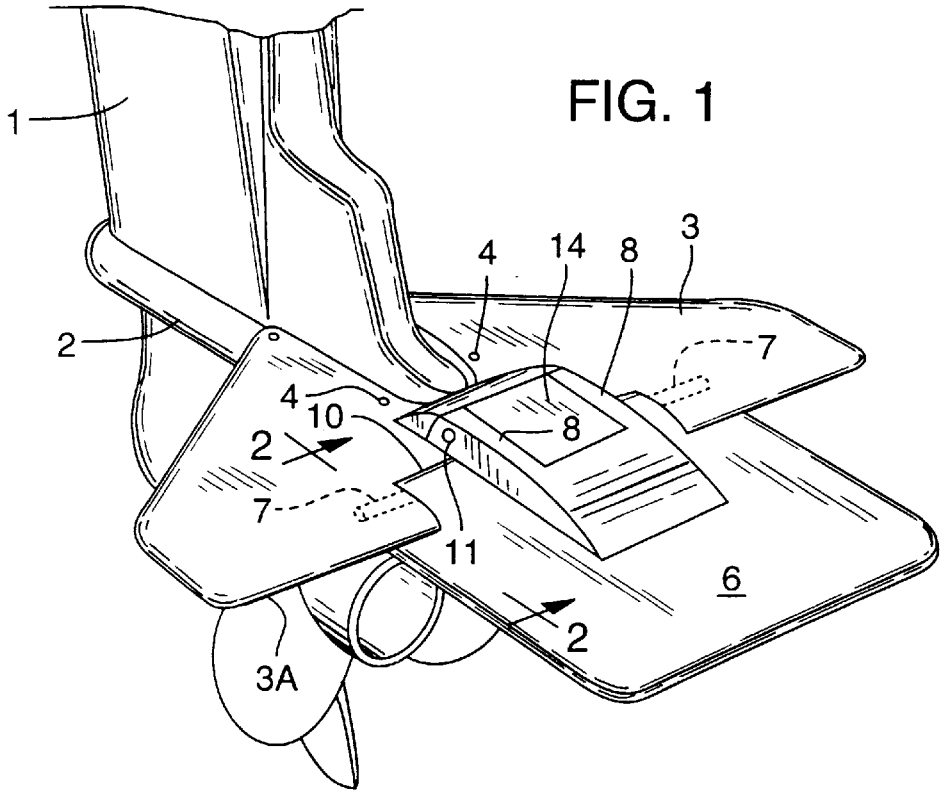
FIGS. 1 and 2 illustrate a prior art trolling plate assembly with the trolling plate in inoperative and operative positions.
Figure 2:
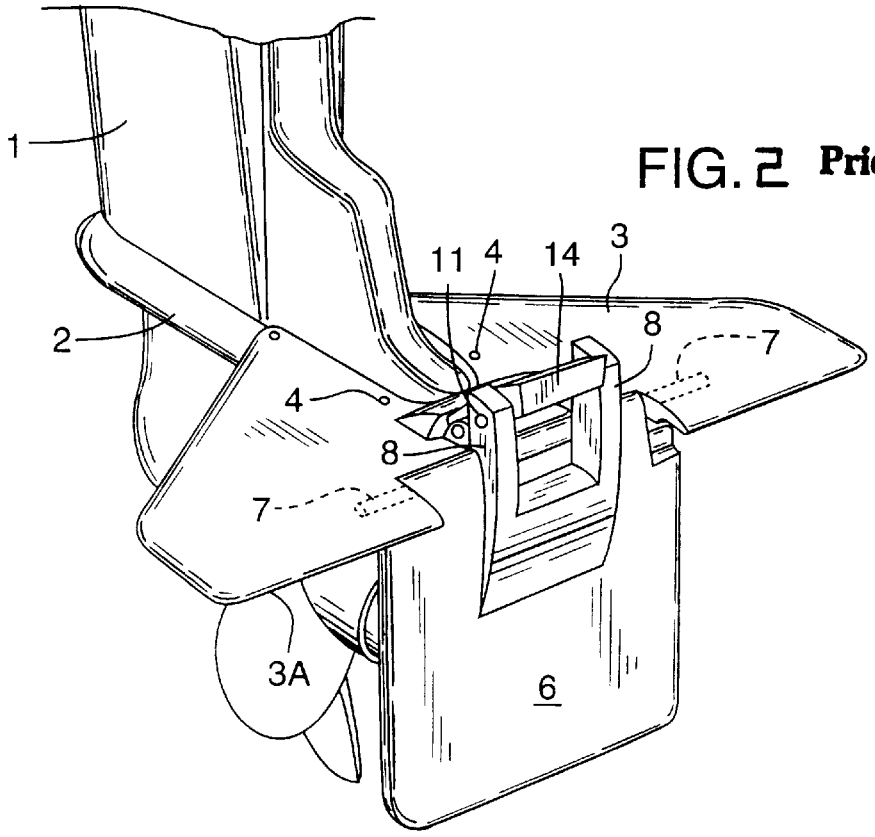
FIG. 2 Prior Art

Incorporated herein by reference is U.S. Pat. No. 5,493,990, providing a detailed description of the trolling plate assembly viewed in FIG. 1 and FIG. 2.

Figure 3:
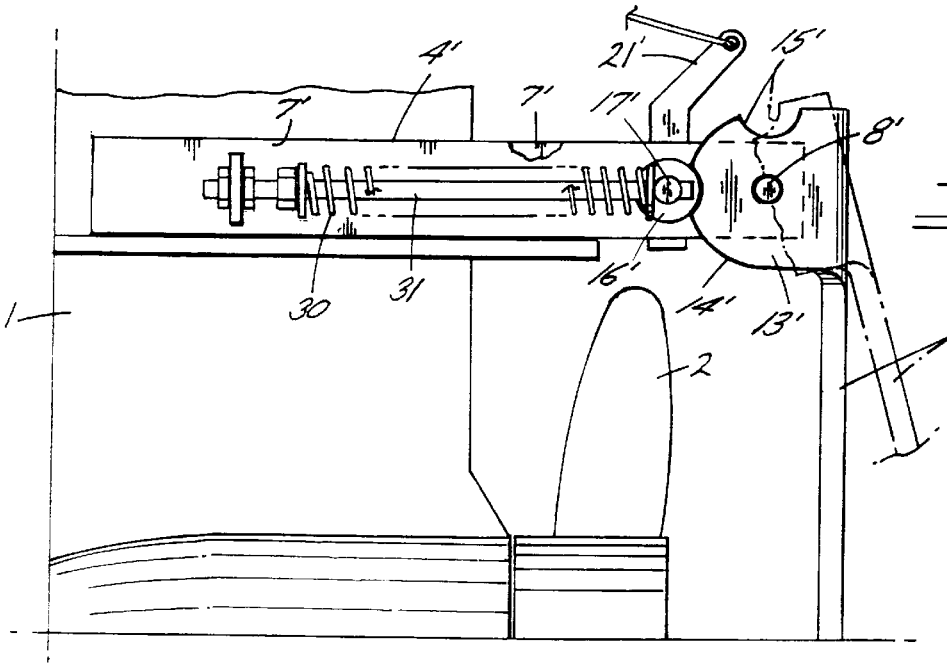
FIG. 3 Prior Art
FIG. 3 is a fragmentary side elevational view of still another prior art trolling plate assembly having a unitary trolling plate.

For a detailed description of the trolling plate assembly shown in FIG. 3, a detailed description is provided in U.S. Pat. No. 5,711,241 also incorporated herein by reference.

Figure 4:
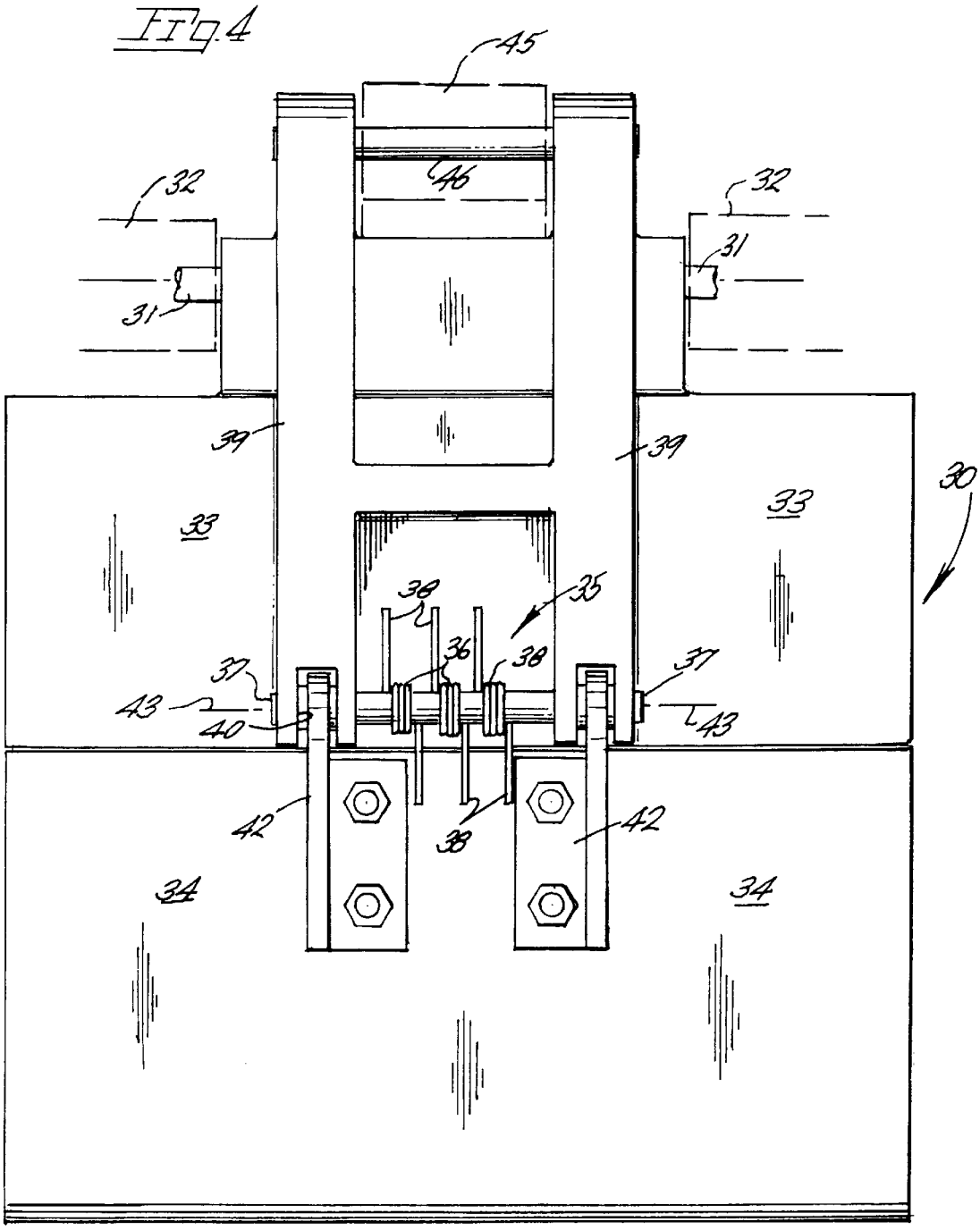
FIG. 4 is a rear elevational view of a segmented trolling plate embodying the preferred from of the present invention.

With attention now to those drawings illustrating the present invention wherein applied reference numerals indicate parts similarly identified herein, the reference numeral 30 indicates generally a trolling plate pivotally attached by a pivot shaft at 31 to a bracket 32 which may be a hydrofoil and attachable to the lower housing of an outboard motor or stem drive of a watercraft propulsion unit for a watercraft. Such brackets are customarily adapted for attachment to a cavitation plate (not shown) on the lower housing, With continuing attention to those drawings illustrating the present invention, and specifically to FIG. 4, the reference numeral 33 indicates a first plate member while a second plate member at 34.

Figure 5:
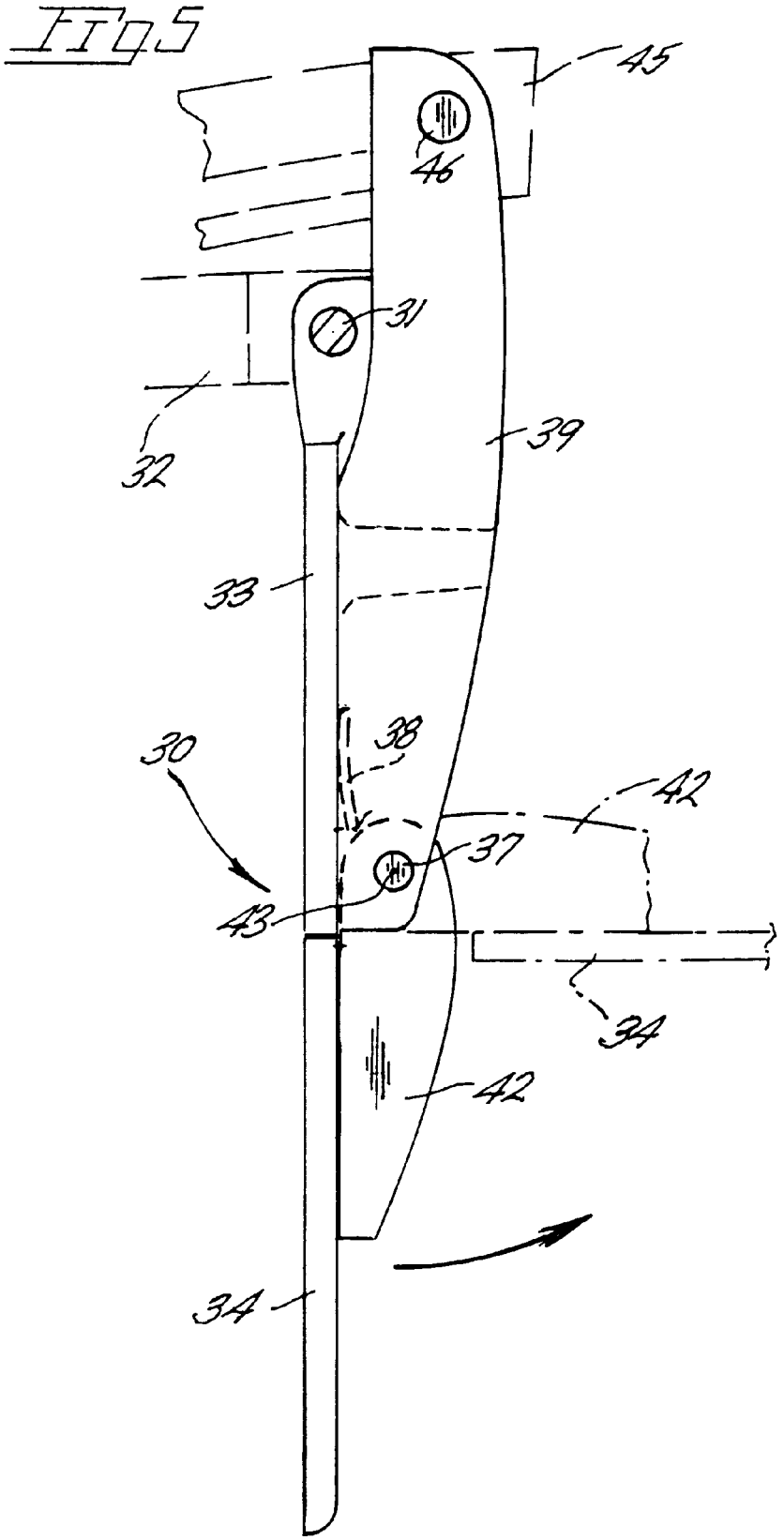
FIG. 5 is a side elevational view of FIG. 4 taken from the left hand side thereof.

A hinge assembly is indicated generally at 35, which serves to position the plate members 33–34 transversely of a backwash flow as best illustrated in FIG. 5. Resilient means at 36, in place on a hinge pin 37, serves to align the plate members 33 and 34 into a normally aligned relationship as shown. While multiple torsion springs are disclosed as resilient means, it will be understood that various spring components may be utilized to best suit the particular propulsion unit. Spring arms are indicated at 38. Plate member 33 may be provided with reinforcing appendages or ribs 39 bifurcated at 40 to receive a hinge 42 in place on second plate member 34. From the foregoing it will be understood that spring biased plate member 34 may move about the axis 43 of crosswise oriented hinge pin 37 toward the broken line position of FIG. 5.

Trolling plate 30, as shown in U.S. Pat. No. 5,493,990, is urged to the extended position shown by torsion springs acting on main member 33. Such torsion springs are disposed about trolling plate pivot shaft 31 with the trolling plate assembly more fully described in U.S. Pat. No. 5,493,990 incorporated herein by reference. A latch mechanism at 45 acts on a locking pin 46 to retain trolling plate 30 in the upright position shown.

If so desired, the hinge assembly 35 may include cooperating pairs of hinges mounted on first and second plate members 33–34 to dispense with modifying the ribs 39.

Figures 6, 7:
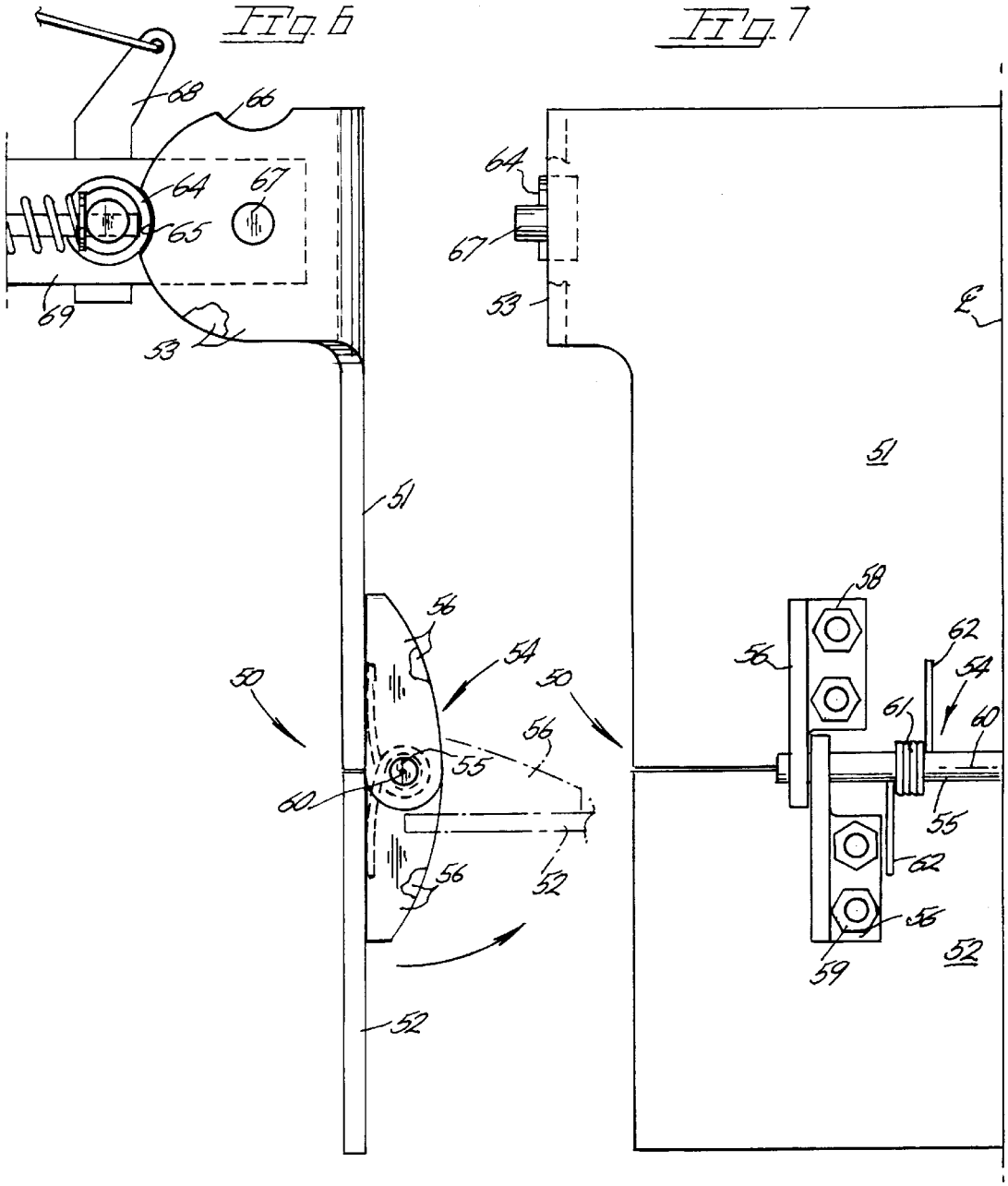
FIG. 6 is a side elevational view of another form of the present trolling plate.
FIG. 7 is a fragmentary elevational view of the modified trolling plate taken from the right side of FIG. 6.

With attention now to FIGS. 6 and 7 showing a modified form of the present trolling plate indicated generally at 50, the same includes a first plate member 51 and a second plate member 52. Hinge means, indicated generally at 54, includes a hinge pin 55 carried by hinge components 56 on first plate member 51 and second plate member 52 suitably secured in place as by fasteners 58 and 59. Accordingly, second trolling plate member 52, when subjected to backwash force, in excess of that occurring during trolling, is adapted for rearward travel about the axis 60 of hinge pin 55. Pairs of torsion springs, one of which springs is indicated at 61, serve to impart downward travel to secondary plate member 52 as spring arms 62 bear on members 51 and 52 respectively. Torsion springs as at 61 bias second plate member 52 to the full line position of FIG. 6 and permit an increased backwash flow (somewhat in excess of trolling speed backwash) to displace second plate member 52 toward the broken line position of FIG. 6 while main plate member 51 remains upright. Such plate retention is by rollers as at 64 each seated in a flange recess 65. Trolling plate 50 is urged to the deployed position shown by torsion springs (not shown) on a plate pivot shaft 67 until such time as backwash on the plate members is sufficient to overcome the torsion springs. A latch mechanism at 68 unseats roller 64 and permits trolling plate 50 to travel about trolling plate pivot shaft 67 to the horizontal whereat a second recess 66 on each flange 53 receives roller 64 to hold the plate elevated out of the backwash flow. For a more complete explanation of the trolling plate assembly used in association with the present trolling plate, reference may be had to U.S. Pat. No. 5,711,241, incorporated herein by reference. A bracket at 69 serves to couple trolling plate 50 to a propulsion unit.

In use, present trolling plate construction permits independent travel of the second plate member at propeller speeds somewhat greater thin propeller speed for straight ahead trolling. For example, when the watercraft is making a turn, settling of the lures to the bottom is prevented by a modest increase in propeller speed. Release of the entire trolling plate from its upright deployed position by the increased backwash flow is prevented by displacement of second plate 34 or 52. In other words, trolling plate embodying the present invention and including first and second plate members, permits momentary speed increases in propeller speed without actuation of a trolling plate latching mechanism as the secondary plate will yield to the increased flow and move to reduce backwash force. Upon resumption of reduced rotational speed of the propeller for trolling along a straight course the secondary plate member will be repositioned by the spring biased hinge means.

In those trolling plate assemblies having trolling plates which are locked in the down position until manual release of the lock by the watercraft operator, the present trolling plate construction will prevent plate damage when the plate is inadvertently left in the down position during high propeller speeds.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. Trolling plate construction for attachment to a watercraft propulsion system and comprising, a bracket attachable to a watercraft propulsion system, first and second trolling plate members, pivot means for coupling the first trolling plate member to said bracket, hinge means coupling said plate members, said second plate member depending from said first plate member, resilient means acting on said second plate member urging same about the axis of said hinge means and toward a position substantially coplanar with said first plate member and into the backwash of a propulsion system to reduce the efficiency of the propulsion system, said resilient means permitting arcuate travel of said second plate member in response to backwash imparted forces occurring at watercraft speeds above trolling speeds.

2. In a trolling plate assembly including bracket means for installation on the submersible portion of a watercraft propulsion system to reduce system efficiency and watercraft speed, the improvement comprising, a trolling plate pivotably mounted on said bracket means and comprising a first plate member and a second plate member both disposed for direct impingement backwash of the propulsion system, and spring-biased hinge means coupling said first and second plate members with the second plate member depending from said first plate member and permitting arcuate movement of said second plate member about the axis of said hinge means in response to backwash forces imparted to the plate by the propulsion unit.

3. A trolling plate assembly for attachment to a watercraft propulsion unit to alter the efficiency of propulsion unit operation and thereby reduce watercraft speeds, said assembly comprising, a bracket for attachment to the submersible portion of the propulsion unit, a trolling plate comprising first and second plate members, hinge means coupling said members, said second plate member depending from said first plate member and permitting relative movement of the second plate member about the hinge axis, resilient means biasing said second plate member toward alignment with said first member, and said bracket including a latch mechanism for retention of the trolling plate in an upright position, said latch mechanism responsive to backwash exerted forces to unlatch the trolling plate.

4. The trolling plate claimed in claim 3 wherein said first plate member includes ribs reinforcing said first plate member.

5. The trolling plate assembly claimed in claim 3 wherein said hinge means includes, a hinge pin, a torsion spring carried by said hinge pin and biasing said second plate member toward substantial alignment with said first plate member.

* * * * *